US005615564A

United States Patent [19]

Inoue

[11] Patent Number: 5,615,564

[45] Date of Patent: Apr. 1, 1997

[54] DOOR LOCKING DEVICE WITH AN ANTITHEFT MECHANISM

[75] Inventor: Jiro Inoue, Yamanashi-ken, Japan

[73] Assignee: Mitsui Kinzoku Kogyo Kabushiki Kaisha, Tokyo, Japan

[21] Appl. No.: 262,893

[22] Filed: Jun. 21, 1994

[30] Foreign Application Priority Data

Jun. 25, 1993 [JP] Japan ..... 5-180025

[51] Int. Cl.[6] ..... E05B 47/00

[52] U.S. Cl. ..... 70/279; 70/264; 292/144; 292/201; 292/216

[58] Field of Search ..... 292/144, 201, 292/216, 280, 341.16, DIG. 26, DIG. 27; 70/264, 277–282, 237–240

[56] References Cited

U.S. PATENT DOCUMENTS

| | | | |
|---|---|---|---|
| 4,364,249 | 12/1982 | Kleefeldt | 70/264 |
| 4,538,845 | 9/1985 | Yamada | 292/216 |
| 4,685,709 | 8/1987 | Kambic | 70/279 X |
| 4,974,886 | 12/1990 | Kleefeldt et al. | 292/201 |
| 4,978,154 | 12/1990 | Kleefeldt et al. | 292/201 |
| 5,072,975 | 12/1991 | Hamada et al. | 292/201 |
| 5,146,772 | 9/1992 | Hamada et al. | 70/264 |
| 5,277,461 | 1/1994 | Dzurko et al. | 292/216 |
| 5,348,357 | 9/1994 | Konchan et al. | 292/216 |
| 5,419,597 | 5/1995 | Brackmann et al. | 292/201 |
| 5,438,855 | 8/1995 | Ikeda | 292/201 X |
| 5,439,261 | 8/1995 | O'Hare | 292/201 X |

FOREIGN PATENT DOCUMENTS

| | | | |
|---|---|---|---|
| 308938 | 3/1989 | European Pat. Off. | 70/283 |
| 3158583 | 7/1991 | Japan . | |

*Primary Examiner*—Suzanne L. Dino
*Attorney, Agent, or Firm*—Browdy and Neimark

[57] ABSTRACT

A door locking device with an antitheft mechanism comprises a main lock lever linked to a key cylinder and changed over from an unlock position to an antitheft position through a lock position, a sub lock lever linked to an inside lock button of the door and changed over to an unlock position and a lock position, and a linkage member having sufficient elasticity to connect the lock levers with each other between the lock position and unlock position. As the main lock lever is displaced from the lock position to the antitheft position the linkage member is elastically deformed and permits the sub lock lever to be left at the lock position, and as the main lock lever is displaced to the antitheft position the sub lock lever is composed so that it can not change over the main lock lever.

6 Claims, 8 Drawing Sheets

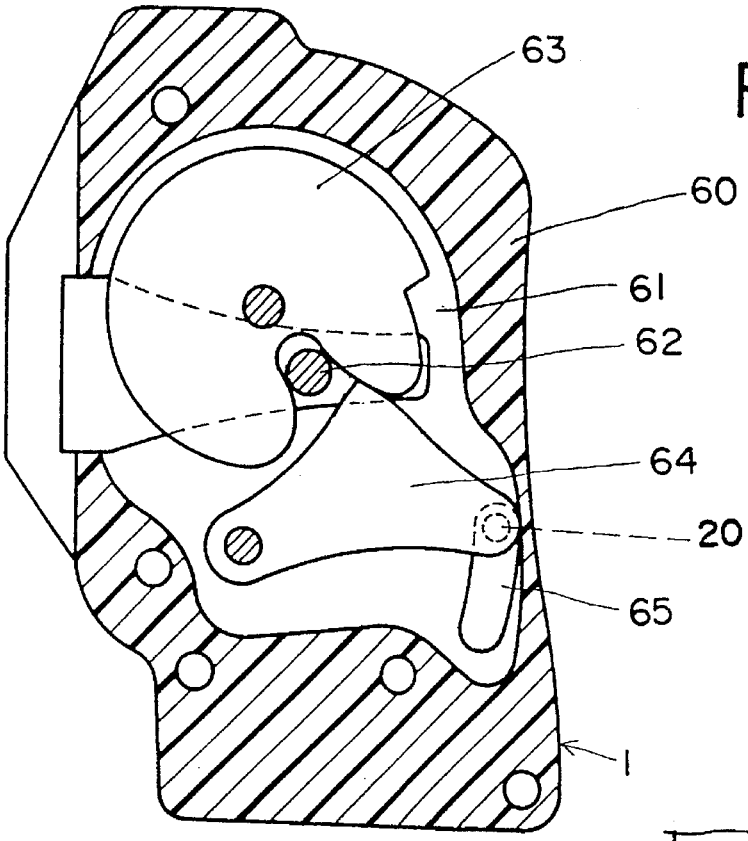
FIG. 2
FIG. 4
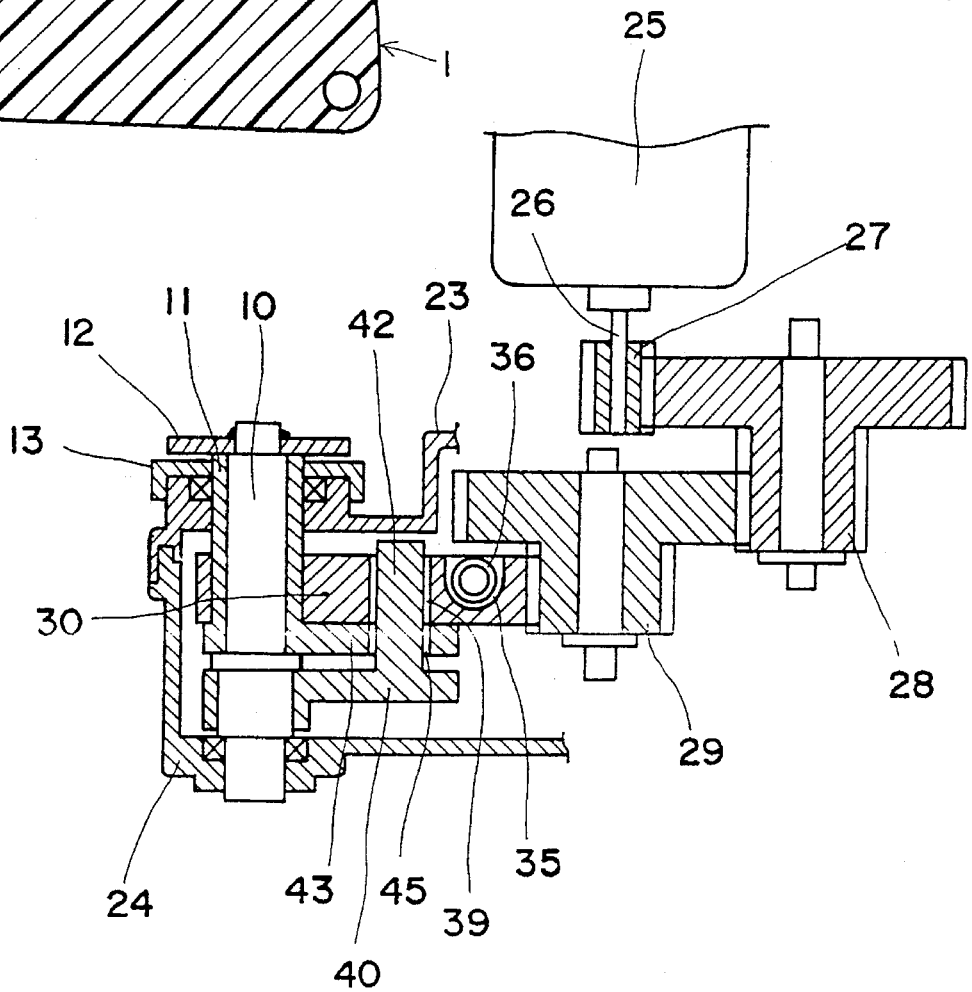

DOOR LOCKING DEVICE WITH AN ANTITHEFT MECHANISM

FIELD OF THE INVENTION

The present invention relates to a door locking device with an antitheft mechanism. The antitheft mechanism means a mechanism which disables the unlocking operation of a lock button installed inside the door.

PRIOR ARTS

Antitheft mechanisms which have been conventionally disclosed are divided into two categories in structure, one of which is called a block system which disables the movements of the inside locking buttons, and the other of which is called a wide swing system which cancels the connection between a locking button and a locking lever to change over the locking state of a locking device. The present invention employs the latter wide swing system.

U.S. Pat. No. 4,978,154 describes an antitheft mechanism of wide swing system. The antitheft mechanism is, as shown in FIG. 14, linked to the key cylinder of the door, and is provided with a main lock lever A for changing over the locking device to the locking state and unlocking state; a sub locking lever C which is linked to the inside lock button B of the door; a connector D for mutually connecting the main lock lever A with the sub lock lever C; and a changeover lever E for causing the connector D to slide laterally. FIG. 14 shows the antitheft state, and the protrusion F of the connector D is separated from the fork portion G of the main lock lever A, while the main lock lever A can not be turned even though the connector D is turned clockwise by the sub lock lever C. If the protrusion F is caused to go in the fork portion G by the changeover lever E from the antitheft state, the antitheft state is cancelled to cause both the lock levers A and C to be connected.

Although the antitheft mechanism needs a connector D installed between both the lock levers A and C and a changeover lever E to cause the connector D to slide, these components can be omitted if it is devised.

Furthermore, Japanese laid-open patent publication No. 3-158583 discloses a wide swing type antitheft mechanism of simple structure, which is shown in FIG. 15 to FIG. 18. This antitheft mechanism has a lock lever b pivotally fixed at a fixed plate a; a rod f having one end connected to the inside lock button c and the other end engaged with the groove d of the lock lever b and the groove e of the plate a; and a rod h having one end connected to the key cylinder g and the other end connected to the lock lever b. When the lock lever b is turned from the position in FIG. 15 to that in FIG. 16, the device is locked. And the antitheft state is reached by turning the lock lever b from the position in FIG. 16 to that in FIG. 17. Even though the lock button c or rod f is moved upwards as shown in FIG. 18 in the antitheft state, the lock lever b does not move. Therefore, the locking state of the locking device can not be cancelled.

A serious issue still remains in the antitheft mechanism described above. FIG. 18 shows a state where the rod f is moved by a thief using a special tool. If the rod f is left in the state shown in FIG. 18 as it is, the lock lever b will be fixed to the plate a by the rod f to the end. Therefore, the lock cylinder b will not be able to be turned even by the key cylinder g, thereby causing the door not to be opened.

SUMMARY OF THE INVENTION

It is therefore an object of the present invention to provide a wide swing type antitheft mechanism of simple structure which is free from any malfunction.

BRIEF DESCRIPTION OF THE DRAWINGS

FIG. 2 is a front elevational view of the latch body, FIG. 3 and FIG. 4 are a partially cutoff cross-sectional view of an actuator unit.

PREFERRED EMBODIMENTS OF THE INVENTION

Figure 1:
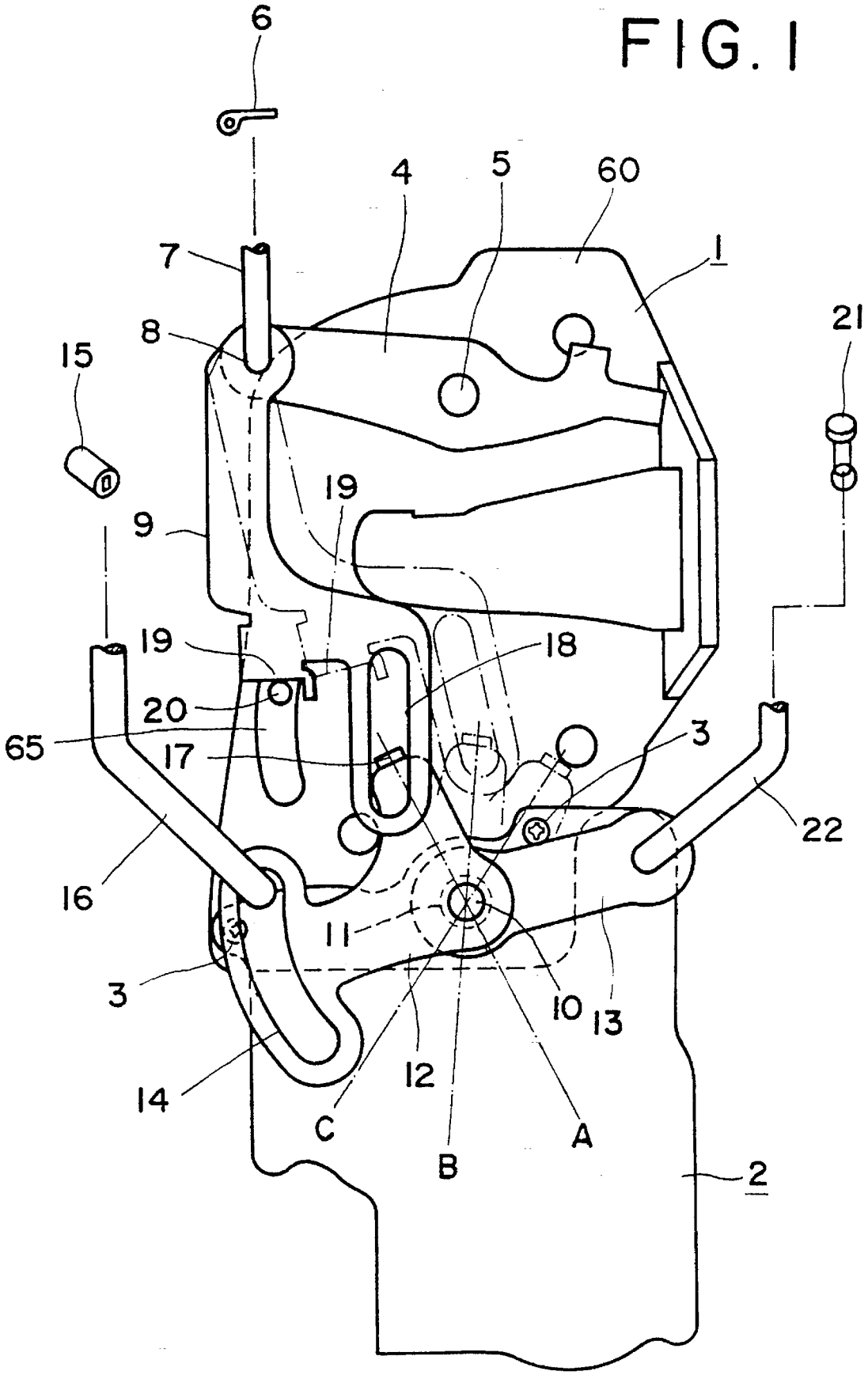
FIG. 1 is a rear elevational view of a door locking device with antitheft mechanism according to the invention.

A preferred embodiment of the invention is described with reference to the drawings attached hereto. A locking device according to the invention is provided with a latch unit 1 and an actuator unit 2 which is fixed with screws 3 at the lower part of the latch unit 1. A synthetic resin body 60 of the latch unit 1 has, as shown in FIG. 2, a concave portion 61 for accommodating several members at the front side thereof, and the concave portion 61 accommodates a latch 63 which is engaged with a striker 62 fixed to the vehicle body and a ratchet 64 which is engaged with the latch 63 and maintains engagement of the latch 63 and the striker 62. A ratchet pin 20 of the ratchet 64 protrudes rearwards of the body 60 through a through hole 65 of the body 60.

As shown in FIG. 1, an opening lever 4 is pivotally fixed with an axis 5 at the rear side of the body 60. A bending portion 8 of the rod 7 extending to the opening handle 6 installed outside the door is engaged with the left end of the opening lever 4. Furthermore, the upper end of the longitudinal link 9 is engaged with the bending portion 8. A longitudinal slot 18 is formed at the lower portion of the link 9. And the bending portion 17 of the main lock lever 12 is caused to be engaged with the slot 18. As the main lock lever 12 is turned centering around the axis 10, the link 9 is caused to swing, centering around the bending portion 8, in interlock with the lock lever 12.

When the lock lever 12 is located at the unlocked position A shown with a solid line in FIG. 1, an engaging piece 19 of the link 9 confronts the pin 20 of the ratchet 64. Therefore, as the link 9 is moved downwards by the opening handle 6 in the unlocked state, the engaging piece 19 is engaged with the pin 20 to cause the ratchet 64 to be freed from the latch 63. As the lock lever 12 is displaced to the locking position B shown with the left side hypothetical line in FIG. 1, the engaging piece 19 is disconnected from the pin 20 to cause the ratchet 64 not to be turned even though the link 9 is moved downwards. Although the conventional traditional lock lever is changed over to two positions, lock position A and unlock position B, the lock lever 12 according to the invention is devised so that it can be further changed to the antitheft position C. The antitheft position C of the lock lever 12 is shown with the right side hypothetical line in FIG. 1. The functions with the lock lever changed over to the antitheft position C will be described later.

The main lock lever 12 is roughly L-shaped, and as shown in FIG. 1, an arcuate slot 14 is formed at the left end. Then, the lower end portion of the rod 16 extending to the key cylinder 15 of the door is engaged with and fixed in the slot 14.

Figure 3:
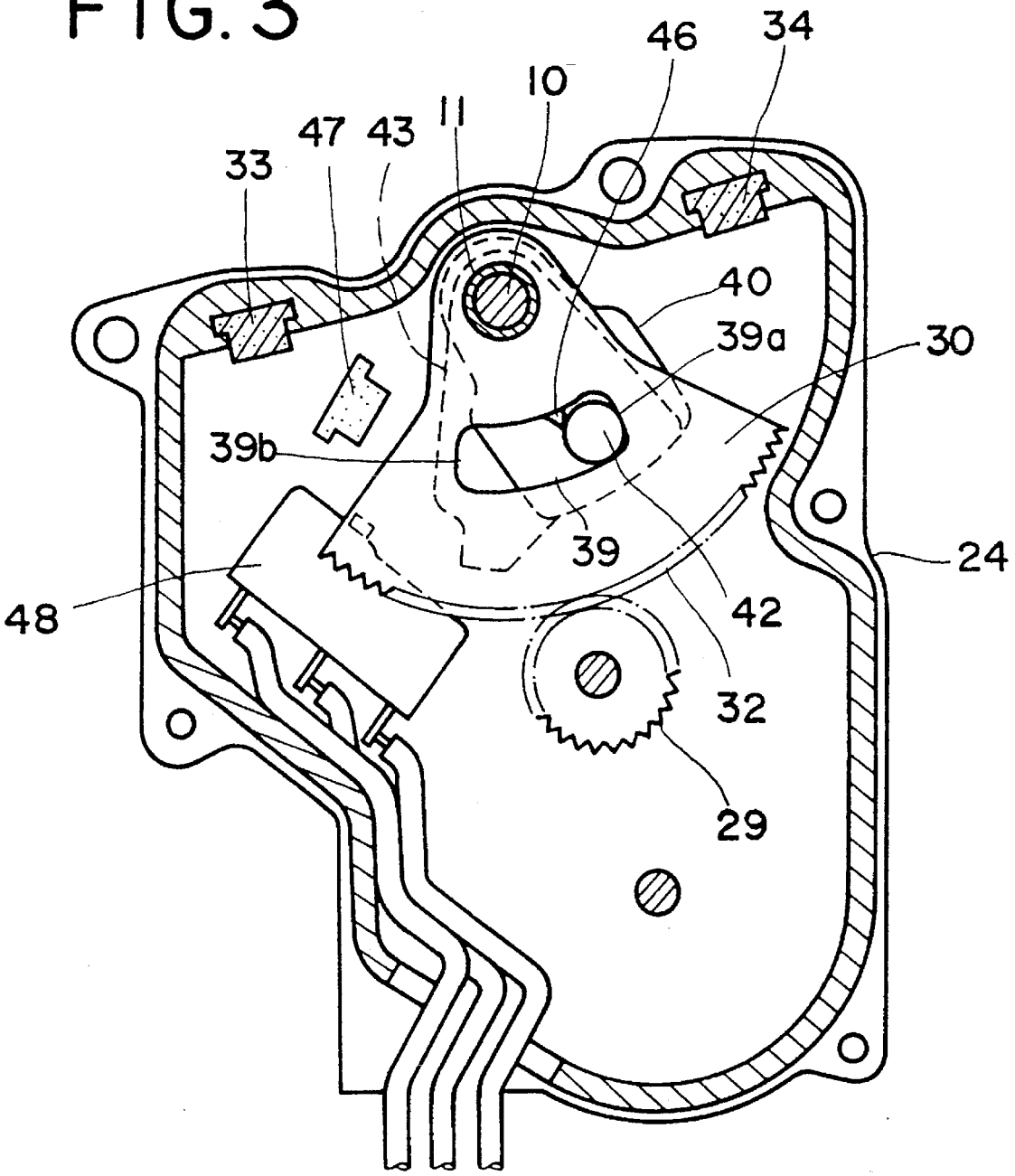

As shown in FIG. 3, the actuator unit 2 has an output axis of a double axes structure consisting of a first axis 10 and a cylindrical second axis 11 which covers the first axis 10. As shown in FIG. 4, the respective ends of the axes 10 and 11 pass through the cover case 23 of the unit 2 and protrude outwards. The main lock lever 12 is fixed at the protruded portion of the first axis 10, and the sub lock lever 13 is fixed at the protruded portion of the second axis 11. As shown in FIG. 1, the end portion of the rod 22 extending to the inside lock button 21 installed inside the door is linked to the turning end of the sub lock lever 13. The first and second axes are linked to each other through an interior mechanism of the unit 2 while the main lock lever 12 is located between the unlock position A and lock position B. Therefore, as one of the lock levers 12 and 13 is turned, the other one thereof is accordingly turned in interlock therewith. However, as the main lock lever 12 is located at the antitheft position C, the interior mechanism of the unit 2 is changed over, and the rotation of the second axis 11 is not transmitted to the first axis 10. Therefore, even though the inside lock button 21 is operated in the vehicle and the sub lock lever 13 is turned, it will be impossible to cause the main lock lever 12 to be moved from the antitheft position C.

The interior structure of the actuator unit 2 is described with reference to FIG. 3 and FIG. 4. The sector-like output member 30 is rotatably supported at the second outer axis 11. Serrations (gear) 32 formed at the outer circumference of the output member 30 are caused to engage with the first reduction gear 29, and the first reduction gear 29 is engaged with a drive gear 27 fixed at the rotating axis 26 of a motor 25 via the second reduction gear 28.

Figure 5:
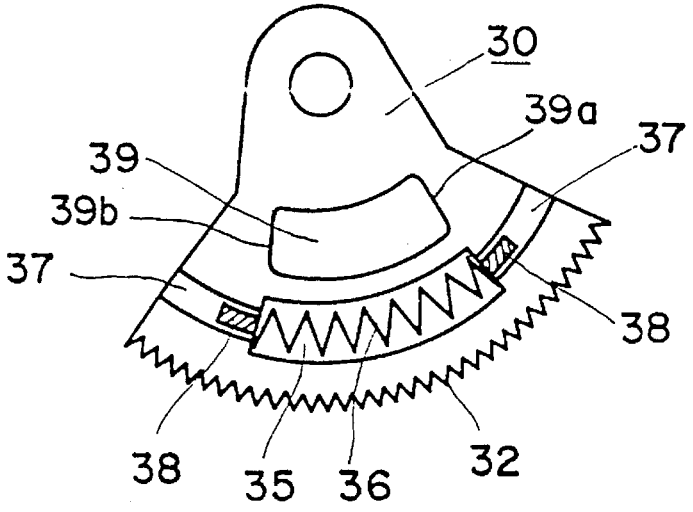
FIG. 5 is a plan view of an output member.

A concave portion 35 of which the section is U-shaped is formed at the output member 30 as shown in FIG. 4 and FIG. 5, and a neutral reset spring 36 is accommodated in the concave portion 35. Narrow slits 37 are communicated from one side to the other of the concave portion 35, and a pair of protrusions 38 formed at the cover case 23 are caused to face inside the slits 37, respectively. Furthermore, in FIG. 3 and from FIG. 9 to FIG. 13, as the views will be complicated, the concave portion 35, spring 36 and members related to these components are omitted. The output member 30 is maintained at the neutral position indicated in FIG. 3 due to elasticity of the spring 36 if the motor 25 is turned off, and as the motor starts, it rotates in either direction while compressing the spring 36 based on the direction of motor rotation.

A key lever 40 is fixed at the first axis 10, and the key lever 40 and main lock lever 12 are composed so that they rotate as a unit. At the key lever 40 is formed an engaging pin 42 which is inserted into the arcuate hole 39 formed on the output member 30. The lateral length of the arcuate hole 39 is made equal to the maximum distance of movement of the engaging pin 42. The pin 42 is in facial contact with the right wall 39*a* of the hole 39 as shown in FIG. 3, when the output member 30 is at the neutral position and the main lock lever 12 is at the unlocked position. And when the output member 30 is at the neutral position and the main lock lever is at the antitheft position, the pin 42 is in facial contact with the left wall 39*b* of the hole 39.

As shown in FIG. 4, an inside lever 43 is arranged between the key lever 40 and the output member 30. The inside lever 43 is rotatably supported at the first axis 10. The outer second axis 11 at which the sub lock lever is fixed is integrally formed with the inside lever 43. An arcuate hole 45 of which the size is equal to that of the arcuate hole 39 of the output member 30 is formed on the inside lever 43, and the pin 42 of the key lever 40 is inserted into the arcuate hole 45. That is, the pin 42 is inserted into both the hole 45 of the inside lever 43 and the hole 39 of the output member 30.

Figure 6:
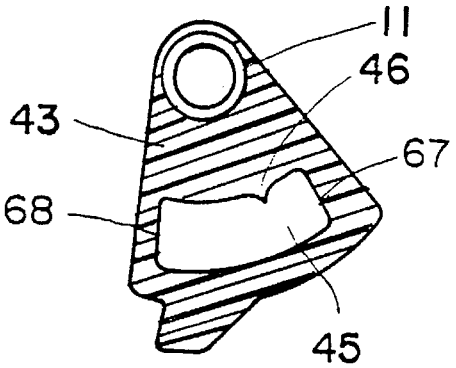
FIG. 6 is a plan view of an inside lock lever.
Figure 7:
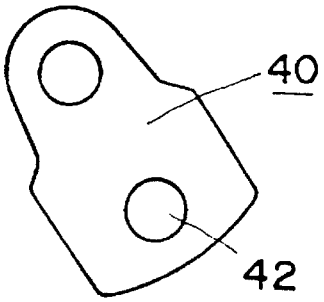
FIG. 7 is a plan view of a key lever.
Figure 8:
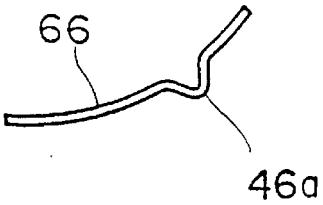
FIG. 8 is a plan view of a leaf spring having an elastic protrusion.

A protrusion 46 is formed at the arcuate hole 45, and the protrusion 46 protrudes in the radial direction of the axis 11 and has adequate elasticity. FIG. 6 shows an example in which the inside lever 43 and protrusion 46 are integrally formed of synthetic resin. Instead of this member, a leaf spring 66 (see FIG. 8) having a protrusion 46*a* may be attached to the arcuate hole 45.

The space between the protrusion 46 and the right wall 67 of the arcuate hole 45 is set to be equal to the thickness of the engaging pin 42. If the engaging pin 42 is located at the right end of the arcuate hole 45, it is composed so that the pin 42 is elastically maintained without play by the protrusion 46 and the right wall 67 (refer to FIG. 9).

Figure 9:
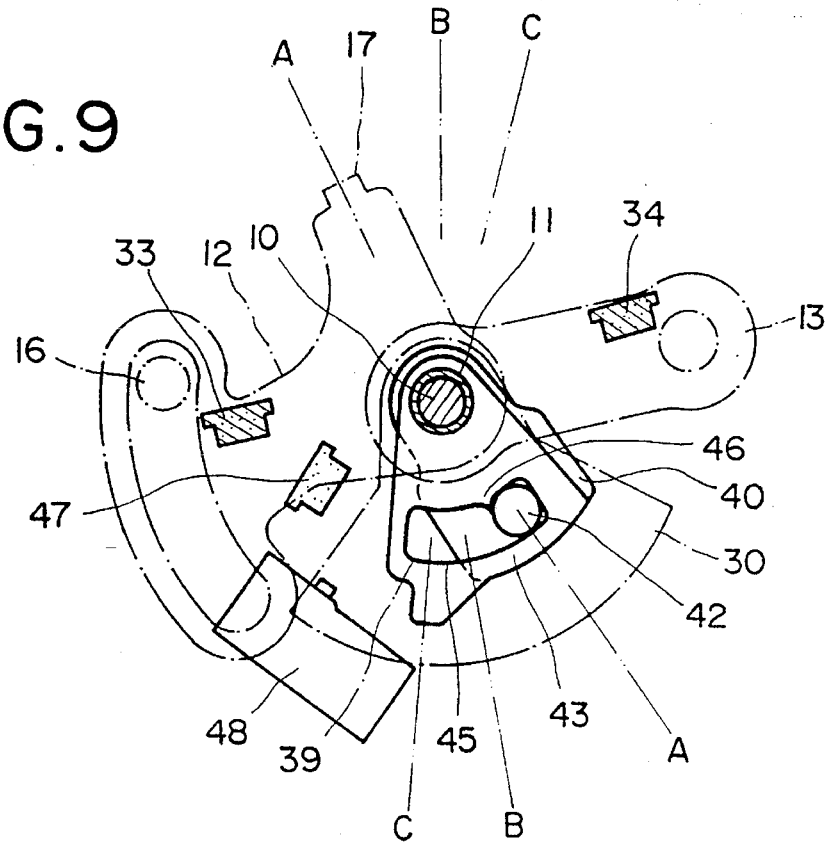
FIG. 9 is a view showing the related components in the unlocked state.
Figure 10:
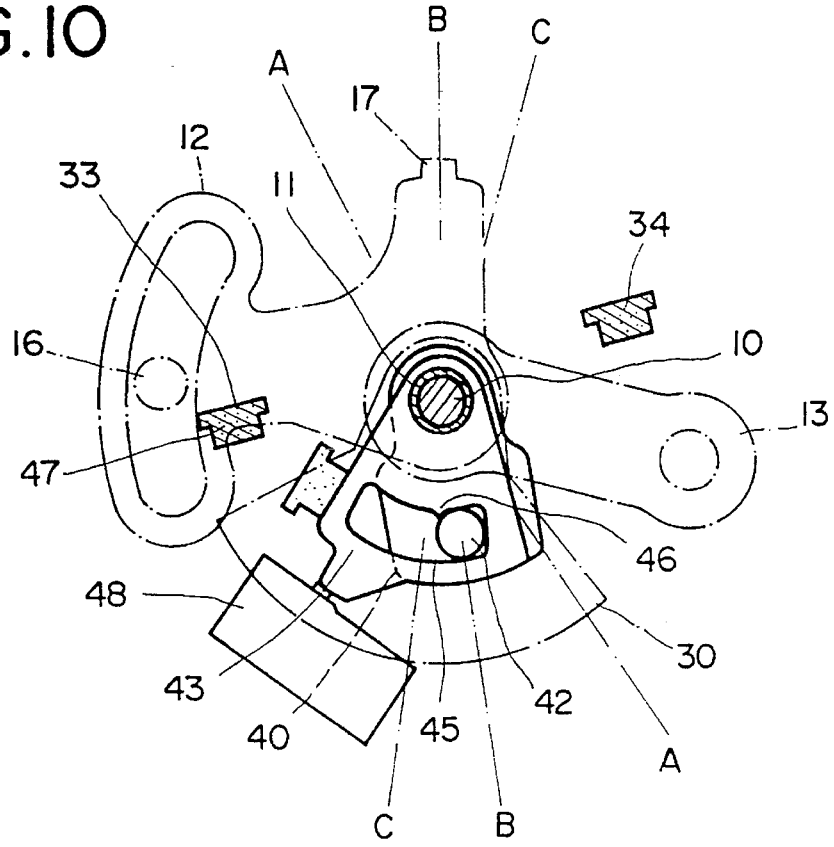
FIG. 10 is a view showing the related components when the output member is turned to the locking position.

The output member 30 shown in FIG. 9 is located at the neutral position, and both the lock levers 12 and 13 are in the unlocked position. In this condition, the hole 39 of the output member is completely overlapped with the hole 45 of the inside lever 43. Moreover, it must be kept in mind that the main lock lever 12 and key lever 40 are fixed through the first axis 10 and the sub lock lever 13 and the inside lever 43 are fixed through the second axis 11. In FIG. 9, if the main lock lever 12 is turned clockwise and is displaced to the locking position B, the pin 42 of the key lever 40 is engaged with the protrusion 46 of the inside lever 43 to cause the sub lock lever 13 to be turned clockwise. Then, the state shown in FIG. 10 is reached. Furthermore, in FIG. 10, if the sub lock lever 13 is turned counterclockwise, the protrusion 46 is engaged with the pin 42 to cause the main lock lever 13 to be turned counterclockwise and to return to the unlocking position A in FIG. 9.

Thus, both the locking levers 12 and 13 are interlocked with each other between the locked state and unlocked state.

A stopper 47 is installed at the base case 24 of the actuator unit 2. The stopper 47 is brought into contact with the side of the inside lever 43 as the inside lever 43 is moved to the locking position in FIG. 10, preventing the inside lever 43 from being turned clockwise beyond the locking position. The stopper 47 is formed with such height that it is not brought into contact with the output member 30. To the base case 24 is attached a switch 48 which is turned on by being pressed by the inside lever 43 as the inside lever 43 reaches the locking position.

Figure 11:
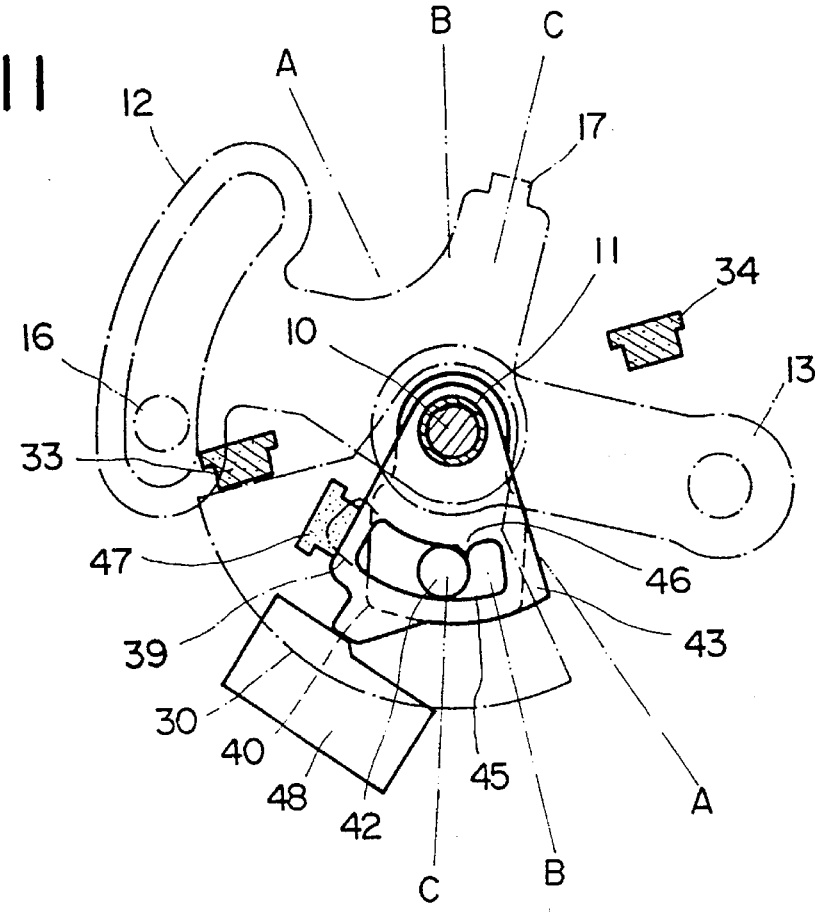
FIG. 11 is a view showing the related components when the output member is turned to the antitheft position.

In the state shown in FIG. 10, as the main lock lever 12 is turned clockwise toward the antitheft position C, the pin 42 is caused to move leftwards from the position shown in FIG. 10. At this time, as it is impossible for the inside lever 43 to be turned clockwise due to being brought into contact with the stopper 47, the pin 42 elastically deforms the protrusion 46 and goes beyond the protrusion 46. And as shown in FIG. 11, it moves leftwards of the protrusion 46. In the state shown in FIG. 11, the main lock lever 12 and key lever 40 are located at the antitheft position, and the sub lock lever 13 and the inside lever 43 are located at the locking position. Even though the sub lock lever 13 is turned counterclockwise as this state is reached, the left wall 68 of the hole 45 of the inside lever 43 is not engaged with the pin 42. Therefore, it is impossible for the main lock lever 12 to be moved from the antitheft position C.

OPERATIONS BY A MOTOR

In the unlocked state in FIG. 9, in a case where the output member 30 is turned clockwise by the motor 25 against the elasticity of the spring 36 through the reduction gears 28 and 29, the right wall 39*a* of the arcuate hole 39 overlapped with the arcuate hole 45 causes the pin 42 of the key lever 40 to move leftwards. Thereby, the main lock lever 12 which is fixed at the key lever 40 through the first axis 10 is turned clockwise and displaced to the locking position in FIG. 10. Simultaneously, the pin 42 is engaged with the protrusion 46 of the inside lever 43 to cause the inside lever 43 and the sub lock lever 13, which is linked with the inside lever 43 through the second axis 11, to be displaced to the locking position in FIG. 10.

As the state of FIG. 10 is reached, the inside lever 43 is brought into contact with the rubber stopper 47 and comes to a stop, and the switch 48 is pressed by the inside lever 43 and is turned on. There are two ways to control when the switch 48 is turned on. One of them is a controlling method to interrupt an electric current flow to the motor 25 by turning-on of the switch 48. As the electric current flow to the motor 25 is interrupted, the output member 30 is reset from the position in FIG. 10 to the neutral position by actions of the spring 36. Therefore, this first control method is employed when changing over the lock device from the unlocking state to the locking state.

In the second control method, the electric current flow to the motor 25 is continued even though the switch 48 is turned on to cause the output member 30 to be further turned clockwise. Then, the right wall 39*a* of the arcuate hole 39 of the output member 30 causes the pin 42 of the key lever 40 to move leftwards. Thereby, the main lock lever 12 is displaced to the antitheft position C. Furthermore, as the inside lever 43 can not be turned clockwise due to being brought into contact with the stopper 47 even though the pin is moved leftwards, the pin 42 elastically deforms the protrusion 46 and moves to the left side of the protrusion 46, going beyond the protrusion 46. FIG. 11 shows the state thereof. As the state in FIG. 11 is reached, the electric current to the motor 25 is discontinued by an adequate means such as a timer, etc, and the output member 30 is returned to the neutral position by actions of the spring 36, and the state in FIG. 12 is reached.

Figure 12:
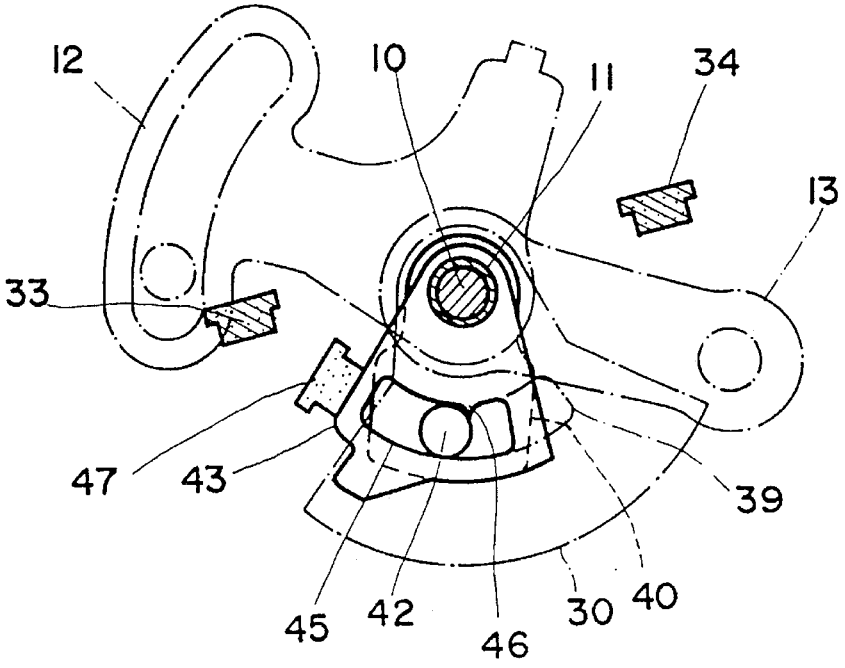
FIG. 12 is a view showing the related components when the output member is returned from the state shown in FIG. 11 to the neutral position.

FIG. 12 is the antitheft state. In this state, the pin 42 of the key lever 40 is located at the left side of the protrusion 46 of the inside lever 43. Because it abuts against protrusions 46, the pin 42 does not slide in arcuate hole 45 of the inside lever 43 the inside lever 43 is turned counterclockwise by the sub lock lever 13. For this reason, even though the sub lock lever 13 is turned in the antitheft state by operating the inside lock button 21 inside the vehicle, it does not move the main lock lever 12 from the antitheft position C.

When cancelling the antitheft state (FIG. 12), the output member 30 is turned counterclockwise by the motor 25 until it is brought into contact with a stopper 34. Then, the left wall 39*b* of the arcuate hole 39 of the output member 30 causes the pin 42 to move rightwards, thereby causing the key lever 40 and the main lock lever 12 to be displaced to the unlocking position through the locking position. At the same time, the pin 42 is engaged with the protrusion 46 to cause the inside lever 43 and the sub lock lever 13 to be displaced to the unlocking position. Furthermore, as shown in FIG. 12, the pin 42 is initially placed at the left side of the protrusion 46. However, as the sub lock lever 13 is located at the unlocking position and is not permitted to turn, the pin 42 goes beyond the protrusion 46 and moves to the right side of the protrusion 46.

OPERATIONS BY THE KEY CYLINDER

The changeover by the key cylinder 15 is basically identical to the operation by the actuator unit 2 and will be described with reference to FIG. 9 to FIG. 13. In the changeover operation by the key cylinder 15, the output member 30 in FIG. 9 to FIG. 13 will not move at all from the neutral position. Therefore, it can be assumed that there is no output member.

In a case where the rod 16 is moved upwards by the key cylinder 15 in the unlocked state in FIG. 9, the main lock lever 12 and key lever 40 are turned clockwise to cause the pin 42 to move leftwards. Then, due to the lost motion of the arcuate hole 39, the output member 30 does not move. However, as the protrusion 46 of the inside lever 43 is elastically engaged with the left side of the pin 42, the inside lever 43 and sub lock lever 13 are turned clockwise, and the state in FIG. 10 is reached. Under this condition, as the operation of the key cylinder 15 is completed, the lock device functions as being locked.

In the state shown in FIG. 10, in a case where the main lock lever 12 is further turned clockwise by the key cylinder 15, the main lock lever 12 is changed over to the antitheft position C. At this time, although the pin 42 is moved leftwards, the inside lever 43 is brought into contact with the rubber stopper 47 and is not turned anymore. Therefore, the pin 42 goes beyond the protrusion 46 and is moved in the arcuate hole 45, and the inside lever 43 and sub lock lever 13 do not move from the lock position.

Figure 13:
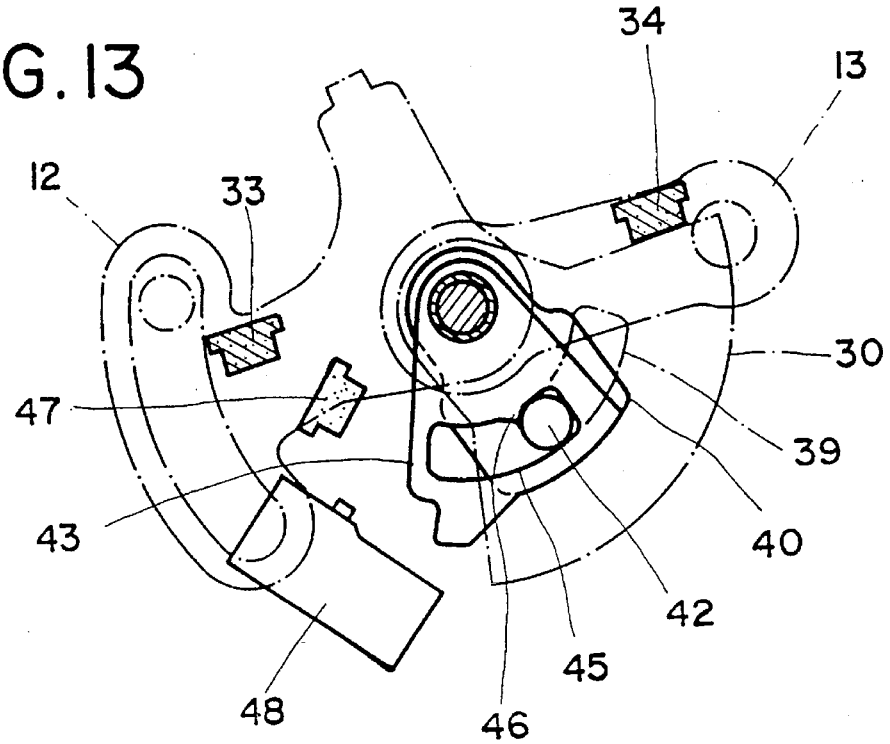
FIG. 13 is a view showing the related components when the output member is turned to the unlocking position.
Figure 14:
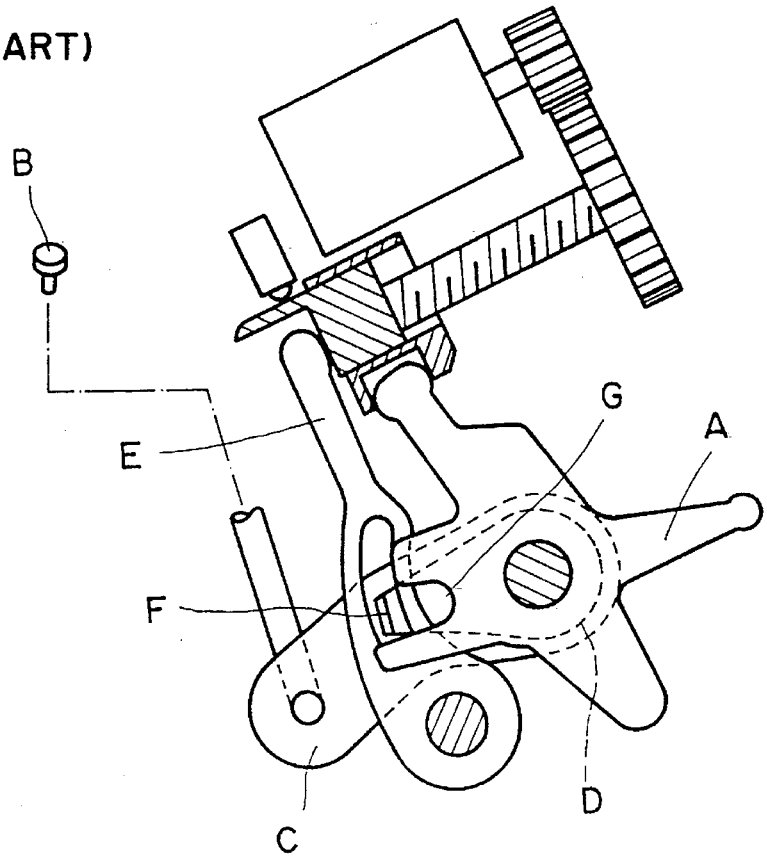
FIG. 14 (PRIOR ART)
FIG. 14 is a view of an already known example showing a simple configuration of the antitheft mechanism disclosed in U.S. Pat. No. 4,978,154.
Figure 15:
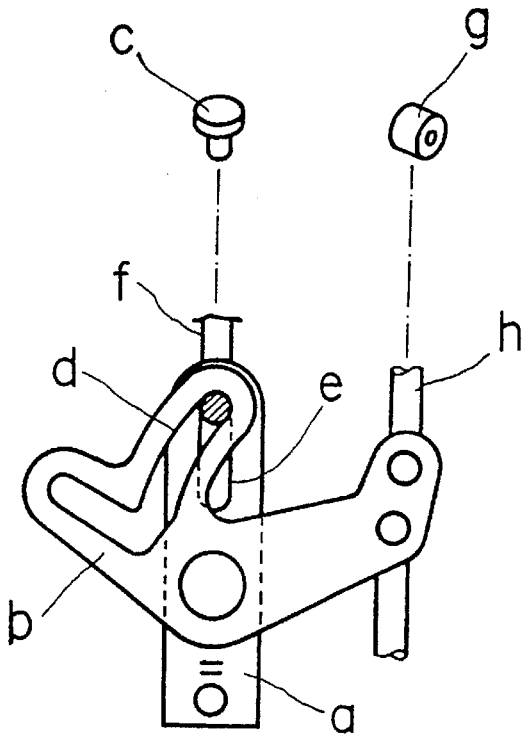
FIG. 15 (PRIOR ART)
FIG. 15 to FIG. 18 are views of an already known example showing the antitheft mechanism disclosed in Japanese laid-open Patent publication No. 3-158583.
Figure 16:
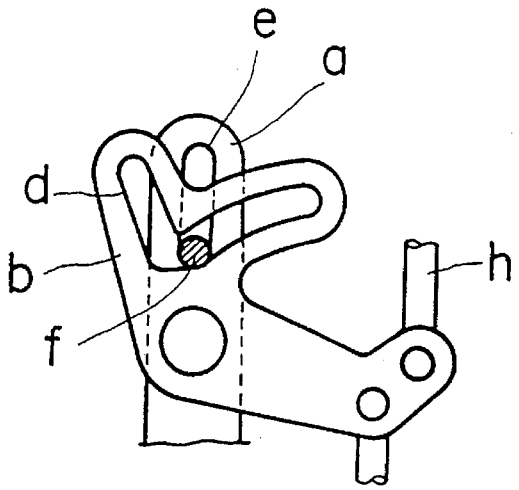
FIG. 16 (PRIOR ART)
Figure 17:
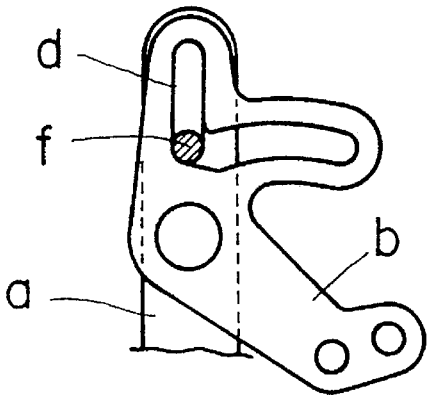
FIG. 17 (PRIOR ART)
Figure 18:
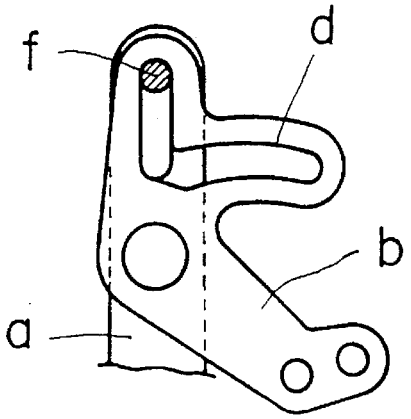
FIG. 18 (PRIOR ART)

When cancelling the antitheft state, the rod 16 is moved downwards by the key cylinder 15 and the main lock lever 12 and key lever 40 are caused to turn counterclockwise. Then, the engaging pin 42 of the key lever 40 is moved rightwards, and the inside lever 43 and sub lock lever 13 are displaced to the unlock position by engagement of the protrusion 46 and engaging pin 42. As the inside lever 43 is not turned anymore after the inside lever 43 is located at the unlock position, the engaging pin 42 goes beyond the elastic protrusion 46 and is moved rightwards of the elastic protrusion 46. Then, the state shown in FIG. 13 is reached. Furthermore, even though the inside lock button 21 is continuously being irregularly operated for unlocking in the antitheft state shown in FIG. 12, it is possible to cancel the antitheft state according to the present invention by turning the key lever 40 counterclockwise by the motor or key cylinder.

Furthermore, the output member 30 which has been described in the above preferred embodiments may be omitted. In this case, the motor 25 is caused to be linked with the key lever 40.

What is claimed is:

1. A door locking device with an antitheft mechanism comprising:

a latch engageable with a striker fixed to a vehicle body;

a ratchet for preventing the latch from being reversely turned in engagement with the latch;

an opening lever for releasing the ratchet from the latch;

a main lock lever linked to a key cylinder of the door, said main lock lever being displaceable from an unlock position to an antitheft position through a lock position and precluding operation of the opening lever when the main lock lever is located at the lock or the antitheft position;

a sub lock lever linked to an inside lock button of the door, said sub lock lever being displaceable from an unlock position and a lock position;

a linkage means integrally engaged to both the main lock lever and the sub lock lever to move the main lock lever and the sub lock lever together between the lock position and the unlock position;

wherein said linkage means is also elastically deformable to permit the sub lock lever to be left in the lock position when the main lock lever is displaced from the lock position to the antitheft position and preclude the sub lock lever from displacing the main lock lever from the antitheft position when the main lock lever is displaced to the antitheft position, wherein the main lock lever and the sub lock lever have the same center of rotation, the linkage means has an arcuate hole on a first cooperative member integrally engaged to the main lock lever, said arcuate hole centering around the center of rotation, an elastic protrusion formed in the arcuate hole and protruding in the radial direction from the center of rotation, and an engaging member on a second cooperative member integrally engaged to the sub lock member, said engaging member being engaged in the arcuate hole, wherein the engaging member is composed so that when the main lock lever is displaced from the lock position to the antitheft position, the engaging member deforms, and moves past, the elastic protrusion.

2. A door locking device with an antitheft mechanism comprising:

a latch engageable with a striker fixed to a vehicle body;

a ratchet for preventing the latch from being reversely turned in engagement with the latch;

an opening lever for releasing the ratchet from the latch;

a main lock lever linked to a key cylinder of the door, said main lock lever being displaceable from an unlock position to an antitheft position through a lock position and precluding operation of the opening lever when the main lock lever is located at the lock or the antitheft position;

a sub lock lever linked to an inside lock button of the door, said sub lock lever being displaceable from an unlock position and a lock position; and an actuator unit, the actuator unit comprising a key lever which is linked to the main lock lever and is integrally displaced with the main lock lever, an inside lever which is linked to the sub lock lever, a motor which displaces the key lever, and elastic linkage means for linking the key lever and the inside lever together;

wherein when the key lever is displaced by the motor from the lock position to the antitheft position, the linkage means is elastically deformed to permit the inside lever to be left in the lock position, and the inside lever precludes displacement of the key lever when the key lever is moved to the antitheft position.

3. A door lock device with an antitheft mechanism according to claim 2, wherein the linkage means comprises a first cooperative member having an elastic element and said first cooperative member being integrally engaged to the key lever and a second cooperative member formed integrally engaged to the inside member, wherein when the key lever is displaced from the lock position to the antitheft position, the second cooperative member deforms the elastic element to permit the main lock lever to move to the anti-theft position while leaving the sub lever in the lock position.

4. A door locking device with an antitheft mechanism according to claim 2, wherein the key lever and inside lever have the same center of rotation, the linkage means has an arcuate hole on the key lever which is integrally engaged to the main lock lever centering around the center of rotation, an elastic protrusion formed in the arcuate hole and protruding in the radial direction from the center of rotation, and an engaging member on the inside lever which is integrally engaged to the sub lock member, said engaging member being engaged in the arcuate hole, and the engaging member is composed so that when the key lever is displaced from the lock position to the antitheft position, the engaging member deforms, and moves past, the elastic protrusion.

5. A door lock device with an antitheft mechanism comprising:

a latch engageable with a striker fixed to a vehicle body;

a ratchet for preventing the latch from being reversely turned in engagement with the latch;

an opening lever for releasing the ratchet from the latch;

a main lock lever linked to a key cylinder of the door, which is displaceable from an unlock position where the opening lever can release the ratchet and a lock position where the ratchet is precluded from being released;

a sub lock lever linked to an inside lock button of the door; and an actuator unit, the actuator unit comprised of an enclosed housing, a first shaft having a first protrusion protruding outwards from the housing, a second shaft having a second protrusion protruding outwards from the housing, a key lever accommodated in the housing and fixed at the first shaft, an inside lever accommodated in the housing and fixed at the second shaft, a motor which displaces the key lever, and an antitheft mechanism displacing the key lever and inside lever to a linked position and a non-linked position thereof, wherein the main lock lever and sub lock lever are fixed at the first protrusion and second protrusion respectively, and the first shaft and second shaft are coaxial.

6. A door lock device with an antitheft mechanism according to claim 5, wherein the second shaft is rotatably within said first shaft.

* * * * *